US009660332B2

(12) United States Patent
Kim et al.

(10) Patent No.: US 9,660,332 B2
(45) Date of Patent: May 23, 2017

(54) ANTENNA APPARATUS AND FEEDING STRUCTURE THEREOF

(71) Applicant: LG INNOTEK CO., LTD., Seoul (KR)

(72) Inventors: Chang Wook Kim, Seoul (KR); Do Gyun Kim, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 78 days.

(21) Appl. No.: 14/283,965

(22) Filed: May 21, 2014

(65) Prior Publication Data

US 2014/0347241 A1 Nov. 27, 2014

(30) Foreign Application Priority Data

May 23, 2013 (KR) ..... 10-2013-0058071
May 28, 2013 (KR) ..... 10-2013-0060405

(51) Int. Cl.

| | |
|---|---|
| ***H01Q 1/24*** | (2006.01) |
| ***H01Q 1/48*** | (2006.01) |
| ***H01Q 9/42*** | (2006.01) |
| ***H01Q 5/35*** | (2015.01) |
| ***H01Q 5/364*** | (2015.01) |

(52) U.S. Cl.

CPC ..... *H01Q 1/48* (2013.01); *H01Q 1/243* (2013.01); *H01Q 5/35* (2015.01); *H01Q 5/364* (2015.01); *H01Q 9/42* (2013.01)

(58) Field of Classification Search

CPC ..... H01Q 1/243; H01Q 1/48; H01Q 9/42
USPC ..... 343/700 MS, 702, 845
See application file for complete search history.

(56) References Cited

U.S. PATENT DOCUMENTS

| | | | | |
|---|---|---|---|---|
| 6,753,815 | B2 * | 6/2004 | Okubora | H01Q 1/243 343/700 MS |
| 2006/0176233 | A1 * | 8/2006 | Tang | H01Q 9/40 343/850 |
| 2007/0222697 | A1 * | 9/2007 | Caimi | H01Q 1/243 343/861 |
| 2010/0328164 | A1 * | 12/2010 | Huynh | H01Q 1/243 343/702 |
| 2011/0205138 | A1 * | 8/2011 | Yanagi | H01Q 9/42 343/845 |

* cited by examiner

*Primary Examiner* — Dieu H Duong
(74) *Attorney, Agent, or Firm* — Saliwanchik, Lloyd & Eisenschenk

(57) ABSTRACT

Disclosed are an antenna apparatus and a feeding structure thereof. The feeding structure includes at least one feeding unit; at least one ground unit connected to the feeding unit; and a ground member connected to the ground unit, and the antenna apparatus includes the feeding structure. Thus, a plurality of signal transferring paths is formed in the antenna apparatus so that the operation efficiency of the antenna apparatus is improved.

20 Claims, 10 Drawing Sheets

(a) General antenna apparatus (b) Antenna apparatus according to embodiment

ANTENNA APPARATUS AND FEEDING STRUCTURE THEREOF

CROSS-REFERENCE TO RELATED APPLICATIONS

This application claims the benefit under 35 U.S.C. §119 of Korean Patent Application Nos. 10-2013-0058071, filed May 23, 2013 and 10-2013-0060405, filed May 28, 2013, which are hereby incorporated by reference in their entirety.

BACKGROUND

The embodiment relates to a configuration of a communication terminal, and more particularly, to an antenna apparatus and a feeding structure thereof.

Generally, a communication terminal includes an antenna apparatus to transmit/receive an electromagnetic wave. The antenna apparatus resonates at a specific frequency band to transmit/receive an electromagnetic wave having a corresponding frequency band. In this case, when the antenna apparatus resonates at the corresponding frequency band, impedance has an imaginary number. Further, an S parameter of the antenna apparatus is rapidly reduced at the corresponding frequency band.

To this end, the antenna apparatus includes a conducting wire having an electric length of $\lambda/2$ with respect to a wavelength $\lambda$ corresponding to the desired resonance frequency band. The antenna apparatus transmits the electromagnetic wave through the conducting wire and the electromagnetic wave forms a standing wave in the conducting wire so that resonance is achieved in the antenna apparatus. In this case, the antenna apparatus may include a plurality of conductive waves having mutually different lengths to expand a resonance frequency band.

However, the operation efficiency of the antenna apparatus may be deteriorated. Since the electric length of the conducting wire in the above-described antenna apparatus is determined corresponding to a resonance frequency band, the size of the antenna apparatus is determined depending on the resonance frequency band. Thus, it is difficult to improve the operation efficiency of the antenna apparatus without enlarging the size of the antenna apparatus.

BRIEF SUMMARY

The embodiment provides an antenna apparatus capable of easily adjusting a resonance frequency band. That is, the embodiment provides an antenna apparatus capable of adjusting the resonance frequency band without enlarging the size of the antenna apparatus.

According to the embodiment, there is provided a feeding structure including at least one feeding unit; at least one ground unit connected to the feeding unit; and a ground member connected to the ground unit, wherein the feeding unit and the ground unit form a plurality of signal transferring paths.

Further, according to the embodiment, there is provided an antenna apparatus including a feeding structure; and a radiator to radiate a signal supplied from the feeding structure, wherein the feeding structure includes at least one feeding unit, at least one ground unit connected to the feeding unit, and a ground member connected to the ground unit, and wherein the feeding unit and the ground unit form a plurality of signal transferring paths.

The antenna apparatus and a feeding structure thereof according to the embodiment include a plurality of signal transferring paths. That is, according to the antenna apparatus and the feeding structure thereof, signals are transferred along the signal transferring paths. In detail, the feeding structure includes a plurality of ground units so that a plurality of ground paths may be formed. Meanwhile, the feeding structure according to the embodiment includes a plurality of feeding units so that a plurality of feeding paths may be formed. Thus, according to the feeding structure thereof, signals may be transferred through the ground paths and the feeding paths. For this reason, the reflection coefficient is significantly reduced at the resonance frequency band of the antenna apparatus. In addition, the operation efficiency of the antenna apparatus is improved. Thus, the operation efficiency of the antenna apparatus can be improved without enlarging the size of the antenna apparatus.

DETAILED DESCRIPTION

Figure 1:
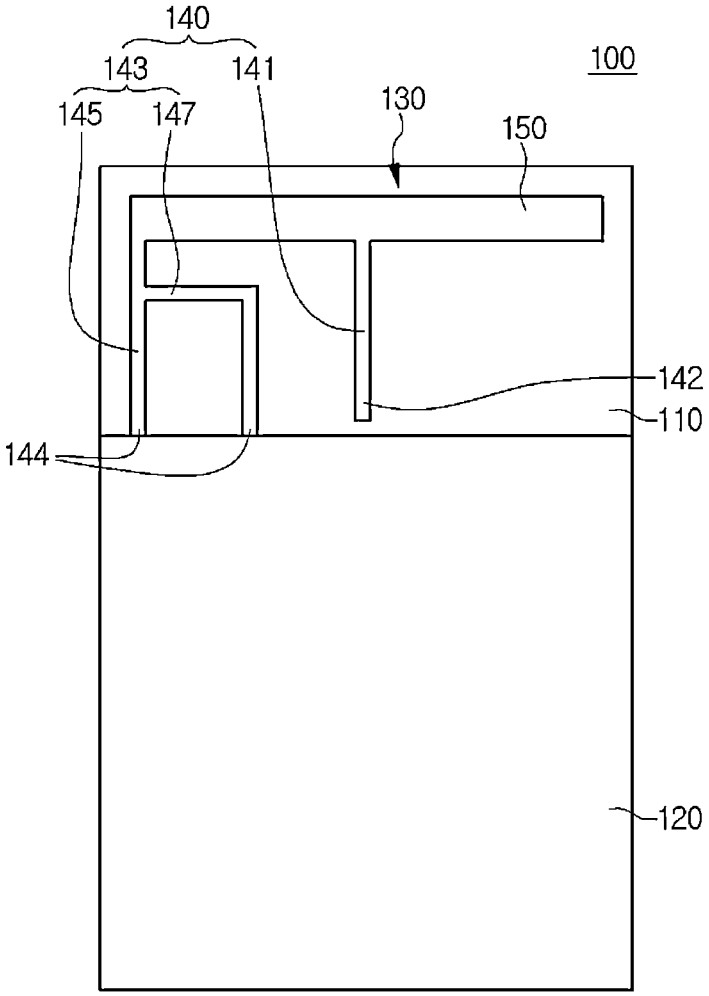
FIG. 1 is a plane view showing an antenna apparatus according to the first embodiment.

Hereinafter, the embodiments will be described with reference to accompanying drawings in detail. In the following description, for the illustrative purpose, the same components will be assigned with the same reference numerals, and the repetition in the description about the same components will be omitted in order to avoid redundancy. Detailed descriptions of well-known functions and structures may be omitted to avoid obscuring the subject matter of the disclosure.

Figure 2:
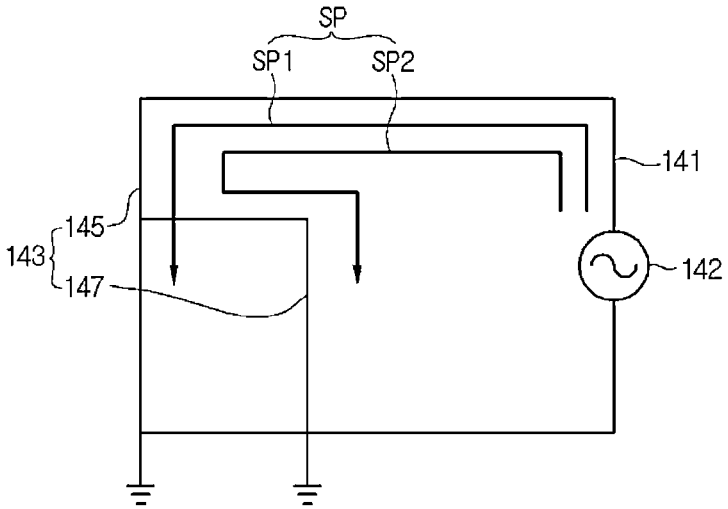
FIG. 2 is a circuit diagram showing an equivalent circuit of a feeding structure in FIG. 1.

FIG. 1 is a plane view showing an antenna apparatus according to the first embodiment. FIG. 2 is a circuit diagram showing an equivalent circuit of a feeding structure in FIG. 1.

Referring to FIG. 1, the antenna apparatus 100 according to the embodiment include a drive substrate 110, a ground member 120 and an antenna element 130.

The drive substrate 110 serves as a power feeder and a supporter in the antenna apparatus 100. The drive substrate 110 has a flat plate structure. In this case, the drive substrate 110 may include a printed circuit board (PCB). The drive substrate 110 may be prepared as a single substrate, and may be prepared by laminating a plurality of substrates.

Further, a transmission line (not shown) is embedded in the drive substrate 110. The transmission line is connected to a control module (not shown) through one end thereof. In addition, the transmission line is exposed through the other end thereof. That is, the transmission line receives a signal from the control module to transfer the signal from one end thereof to the other end thereof.

Further, the drive substrate 110 includes a dielectric substance. The drive substrate 110 may have conductivity $\sigma$ of 0.02. Moreover, the drive substrate 110 may have permittivity $\in$ of 4.4. In addition, the drive substrate 110 may have loss tangent of 0.02. In this case, the transmission line may include a conductive material. The transmission line may include at least one of silver (Ag), palladium (Pd), platinum (Pt), copper (Cu), gold (Au), and nickel (Ni).

The ground member 120 is provided for ground in the antenna apparatus 100. The ground member 120 is formed on a portion or the entire area of the drive substrate 110. In this case, the ground member 120 is spaced apart from the transmission line. That is, the ground member 1200 is not electrically connected to the transmission line. In this case, the ground member 120 may be disposed on at least one of top and bottom surfaces of the drive substrate 110. When the drive substrate 110 includes a plurality of substrates, the ground member 120 may be disposed between the substrates.

The antenna element 130 is provided to transmit/receive a signal in the antenna apparatus 100. In this case, the antenna element 130 operates when a signal is supplied from the drive substrate 110 to the antenna element 130. In addition, the antenna element 130 resonates at preset impedance.

The antenna element 130 is disposed in the drive substrate 110. In this case, the antenna element 130 may be disposed on a top surface of the drive substrate 110. In addition, the antenna element 130 makes contact with the transmission line. Further, the antenna element 130 makes contact with the ground member. The antenna element 130 includes a feeding structure 140 and a radiator 150.

The feeding structure 140 supplies a signal to the antenna element 130. That is, the feeding structure 140 operates the radiator 150. The feeding structure 140 is disposed on the drive substrate 110. In this case, the feeding structure 140 may be attached onto the top surface of the drive substrate 110.

The feeding structure 140 includes a conductive material. The feeding structure 140 may include at least one of Ag, Pd, Pt, Cu, Au and Ni.

The feeding structure 140 includes a feeding unit 141 and a plurality of ground units 143.

The feeding unit 141 provides a signal to the feeding structure 140. The feeding unit 141 makes contact with the transmission line through one end thereof. In this case, the one end of the feeding unit 141 is defined as a feeding point (FP) 142. For example, the feeding point 142 may make contact with the transmission line at a location close to the ground member 120. In other words, the feeding point 142 does not make contact with the ground member 120. Thus, a signal is provided from a control module to the feeding unit 141. Further, the feeding unit 141 extends from feeding point 142 through the other end thereof. Thus, a signal is supplied from one end of the feeding unit 141 to the other end of the feeding unit 141.

The ground units 143 ground the feeding structure 140. That is, the ground units 143 connect the feeding unit 141 to the ground member 120. Each of the ground units 143 makes contact with the ground member 120 through one end thereof. One end of each of the ground units 14 is defined as a ground point 144. That is, the ground units 143 make contact with the ground member 120 at the plurality of ground points 144. Further, each of the ground units 143 extends from the ground member 120 through the other end thereof. Thus, the ground units 143 are grounded to the ground member 120 and transmit a signal from the feeding unit 141 to the ground member 120.

In this case, the ground units 143 are coupled to each other at the other ends thereof. In other words, the ground units 143 diverge from each other at the other ends thereof. The ground units 143 have mutually different lengths. In addition, the ground units 143 are have mutually different shapes. The ground units 143 may be asymmetrical to each other. For example, the ground units 143 may include a first ground unit 145 and a second ground unit 147. In this case, the second ground unit 147 may be disposed between the feeding unit 141 and the first ground unit 145.

In addition, the feeding structure 140 is designed to have a predetermined electrical property. For example, as shown in FIG. 2, the feeding structure 140 may be designed. The feeding unit 141 and the ground unit 143 are expressed as conductive wires.

That is, the feeding unit 141 extends from the feeding point 142 and the ground units 143 extend from the feeding unit 141, so that the feeding unit 141 is grounded. In this case, a plurality of signal transferring paths TP is formed in the feeding structure 140. The signal transfer paths TP include a plurality of shorting paths SP. For example, a first shorting path SP1 may be formed along the first ground unit 145 from the feeding unit 141 and a second shorting path SP2 may be formed along the second ground unit 147 from the feeding unit 141. That is, signals are transferred along each shorting path SP from the feeding unit 141.

The radiator 160 is provided to substantially operate the antenna element 130. That is, a signal is provided from the feeding structure 140 to the radiator 150 so that the radiator 150 operates. The radiator 150 is electrically connected to the feeding structure 140. In addition, the radiator 150 is made of a conductive material. The radiator 150 may include at least one of Ag, Pd, Pt, Cu, Au and Ni.

The antenna apparatus 100 according to the embodiment operates at a resonance frequency band. At this time, as a signal is provided from the feeding unit 141 of the feeding structure 140 to the radiator 150, the radiator 150 operates. In addition, as a signal is supplied from the ground units 143 of the feeding structure 140 to the ground member 120, the ground member 120 operates. In other words, the ground member 120 radiates a signal together with the radiator 150.

Figure 3:
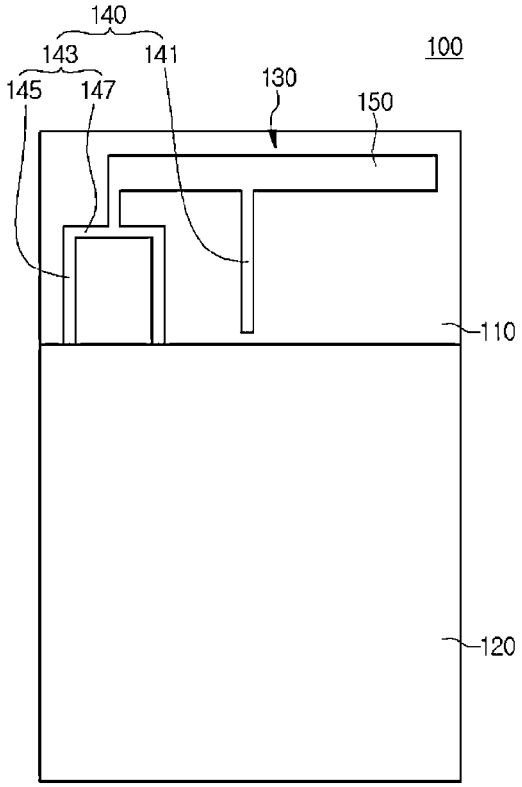
FIG. 3 is a plane view showing the first modifying example of an antenna apparatus according to the first embodiment.

FIG. 3 is a plane view showing the first modifying example of an antenna apparatus according to the first embodiment.

Referring to FIG. 3, according to the antenna apparatus 100 of the embodiment, the ground units 143 are coupled to each other at the other ends thereof. In other words, the ground units 143 diverge from each other at the other ends thereof. As described above, the ground units 143 may have mutually different lengths or may have the same length. In addition, the ground units 143 may have mutually different shapes. That is, the ground units 143 may be symmetrical to each other.

Figure 4:
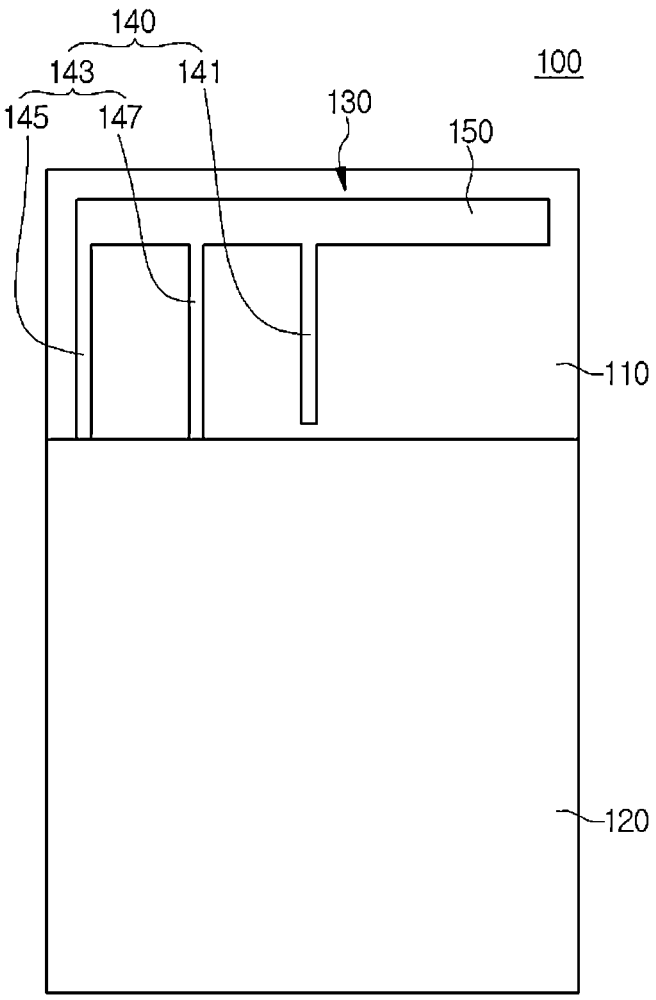
FIG. 4 is a plane view showing the second modifying example of an antenna apparatus according to the first embodiment.

FIG. 4 is a plane view showing the second modifying example of an antenna apparatus according to the first embodiment.

Referring to FIG. 4, according to the antenna apparatus 100 of the embodiment, as described above, the ground units 143 may be coupled to each other at the other ends thereof or may not be coupled to each other at the other ends thereof. In other words, the ground units 143 may make contact with mutually different portions of an additional metallic member (not shown) connected to the radiator 150 or the feeding unit 141. In this case, the ground units 143 may have the same length. In addition, the ground units 143 may be formed in the same shape. That is, the ground units 143 may be symmetrical to each other.

Meanwhile, although not shown, the ground units 143 may have mutually different lengths. In addition, the ground units 143 may have mutually different shapes. That is, the ground units 143 may be asymmetrical to each other.

Figure 5:
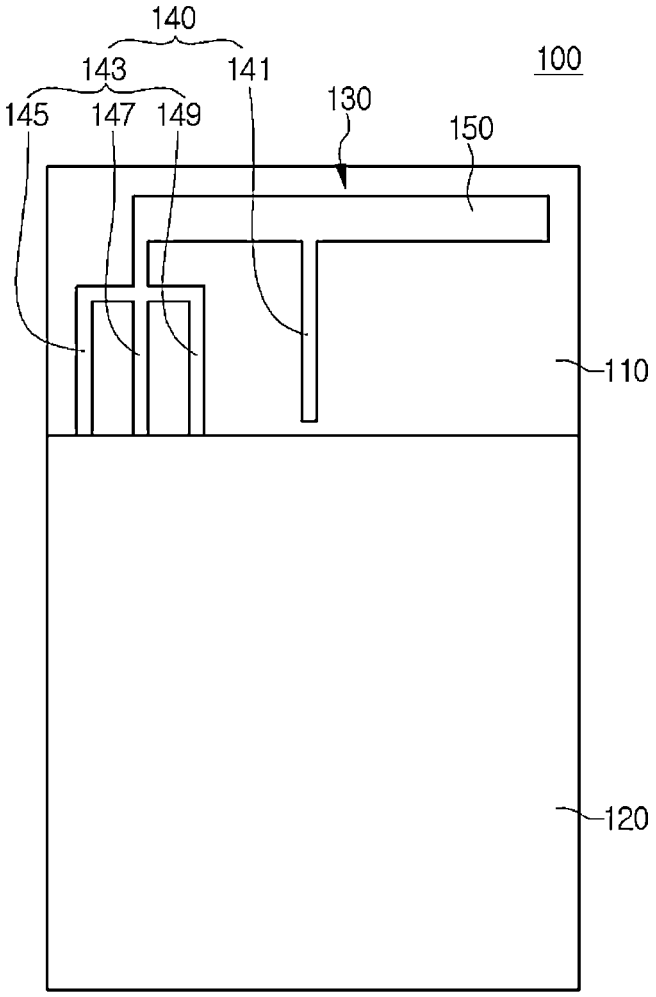
FIG. 5 is a plane view showing the third modifying example of an antenna apparatus according to the first embodiment.

FIG. 5 is a plane view showing the third modifying example of an antenna apparatus according to the first embodiment.

Referring to FIG. 5, the antenna apparatus 100 according to the embodiment includes a plurality of ground units 143. In this case, as described above, the antenna apparatus 100 may include two ground units 143, or at least three ground units 143. For example, the ground units 143 may include a first ground unit 145, a second ground unit 147 and a third ground unit 149. In this case, the second ground unit 147 may be disposed between the first and third ground units 145 and 149, and the third ground unit 149 may be disposed between the feeding unit 141 and the second ground unit 147.

In addition, the ground units 143 may be coupled to each other at the other ends thereof. In other words, the ground units 143 diverge from each other at one ends thereof. In addition, the ground units 143 may have mutually different lengths or may have the same length. Further, the ground units 143 may have mutually different shapes.

Meanwhile although not shown, two of the ground units 143 may not be coupled to each other. In other words, at least two of the ground units 143 may make contact with mutually different portions of an additional metallic member (not shown) connected to the radiator 150 or the feeding unit 141. In addition, two of the ground units 143 may have mutually different lengths or the same length. Further, two of the ground units 143 may be formed in mutually different shapes or the same shape.

In this case, according to the antenna apparatus 100 of the embodiment, the number of ground units 143, the divergence position and the lengths and shapes of the ground units 143 are determined according to the predetermined ground condition. In other words, the number of ground paths SP and size and shape of each ground path SP may be determined according to the ground condition predetermined in the antenna apparatus 100. In this case, the ground condition is to determine the performance of the ground member 120 and for example, includes the size of the ground member 120. For this reason, the reflection coefficient may be significantly reduced at the resonance frequency band of the antenna apparatus 100. In addition, the operation efficiency of the antenna apparatus 100 may be improved.

Figure 6:
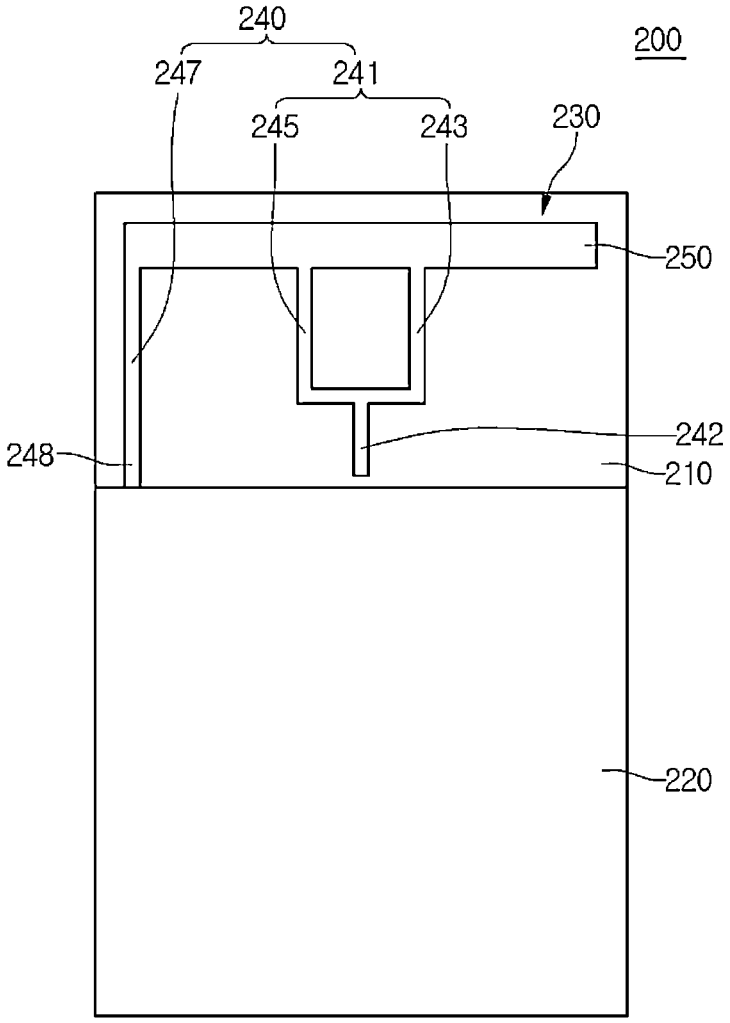
FIG. 6 is a plane view showing an antenna apparatus according to the second embodiment.
Figure 7:
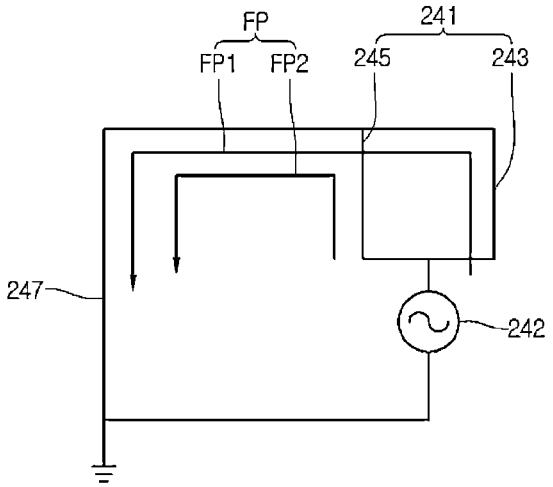
FIG. 7 is a circuit diagram showing an equivalent circuit of a feeding structure in FIG. 6.

FIG. 6 is a plane view showing an antenna apparatus according to the second embodiment. FIG. 7 is a circuit diagram showing an equivalent circuit of a feeding structure in FIG. 6.

Referring to FIG. 6, the antenna apparatus 200 according to the embodiment include a drive substrate 210, a ground member 220 and an antenna element 230. In addition, the antenna element 230 includes a feeding structure 240 and a radiator 250. Since the configurations of the embodiment are similar to those of the above-described embodiment, the detail descriptions will be omitted.

Only, the feeding structure 240 of the embodiment includes a plurality of feeding units 241 and a ground unit 247.

The feeding units 241 provide a signal to the feeding structure 240. The feeding units 241 make contact with a transmission line through one ends thereof. In this case, the one ends of the feeding units 241 are defined as a feeding point (FP) 242. For example, the feeding point 242 may make contact with the transmission line at a location close to the ground member 220. In other words, the feeding point 242 does not make contact with the ground member 220. Thus, a signal is provided from a control module to the feeding units 241. Further, each of the feeding units 241 extends from the feeding point 242 through the other end thereof. Thus, a signal is supplied from one ends of the feeding units 241 to the other ends of the feeding units 241.

In this case, the feeding units 241 are coupled to each other at the one ends thereof. In other words, the feeding units 241 diverge from each other at the other ends thereof. The feeding units 241 have the same length. In addition, the feeding units 241 have mutually different shapes. The feeding units 241 may be symmetrical to each other. For example, the feeding units 241 may include a first feeding unit 243 and a second feeding unit 245. In this case, the second feeding unit 245 may be disposed between the first feeding unit 243 and the ground unit 247.

The feeding structure 240 is grounded through the ground unit 247. That is, the ground unit 247 connects the feeding units 241 to the ground member 220. The ground unit 247 makes contact with the ground member 220 through one end thereof. The one end of the ground unit 247 is defined as the ground point 248. In addition, the ground unit 247 extends from the ground member 220 through the other end thereof. In this case, the ground unit 247 makes contact with the feeding units 241 through the other end thereof. Thus, the ground unit 247 is grounded to the ground member 220 and transfers a signal from the feeding units 241 to the ground member 220.

In addition, the feeding structure 140 is designed to have a predetermined electrical property. For example, as shown in FIG. 2, the feeding structure 140 may be designed. The feeding unit 141 and the ground unit 143 are expressed as conductive wires That is, the feeding units 241 extend individually from the feeding point 242 and the ground unit 247 extends from the feeding units 241, so that the feeding units 241 are grounded. In this case, a plurality of signal transferring paths TP is formed in the feeding structure 240. The signal transferring paths TP include a plurality of feeding paths FP. For example, a first feeding path FP1 may be formed the first feeding unit 243 to the ground unit 247 and a second feeding path FP2 may be formed from the second feeding unit 245 to the ground unit 247. That is, signals are transferred along each feeding path FP through each feeding unit 241.

Figure 8:
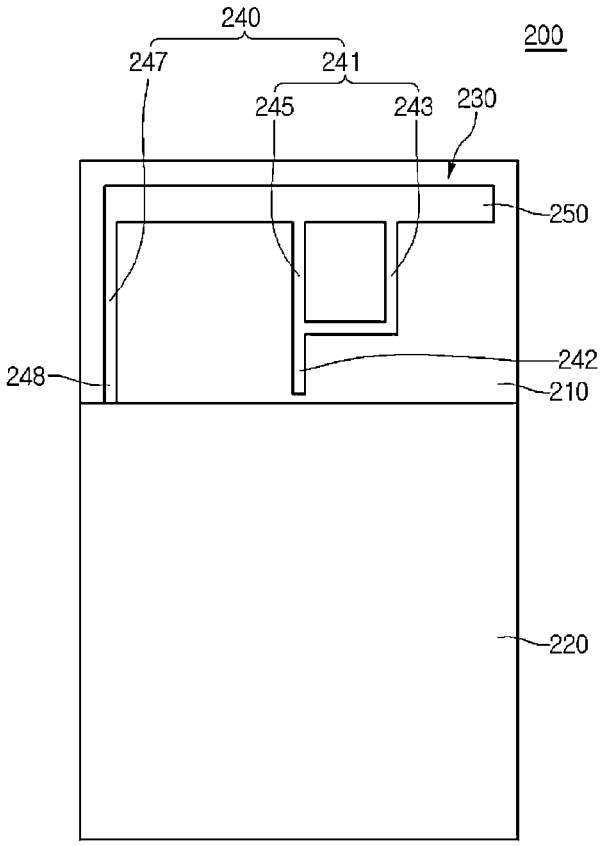
FIG. 8 is a plane view showing the first modifying example of an antenna apparatus according to the second embodiment.

FIG. 8 is a plane view showing the first modifying example of an antenna apparatus according to the second embodiment.

Referring to FIG. 8, according to the antenna apparatus 200 of the embodiment, the feeding units 241 are coupled to each other at one ends thereof. In other words, the feeding units 241 diverge from each other at the other ends thereof. As described above, the feeding units 241 may have the same length or mutually different lengths. In addition, the feeding units 241 may have mutually different shapes. In this case, the feeding units 241 may be asymmetrical to each other.

Figure 9:
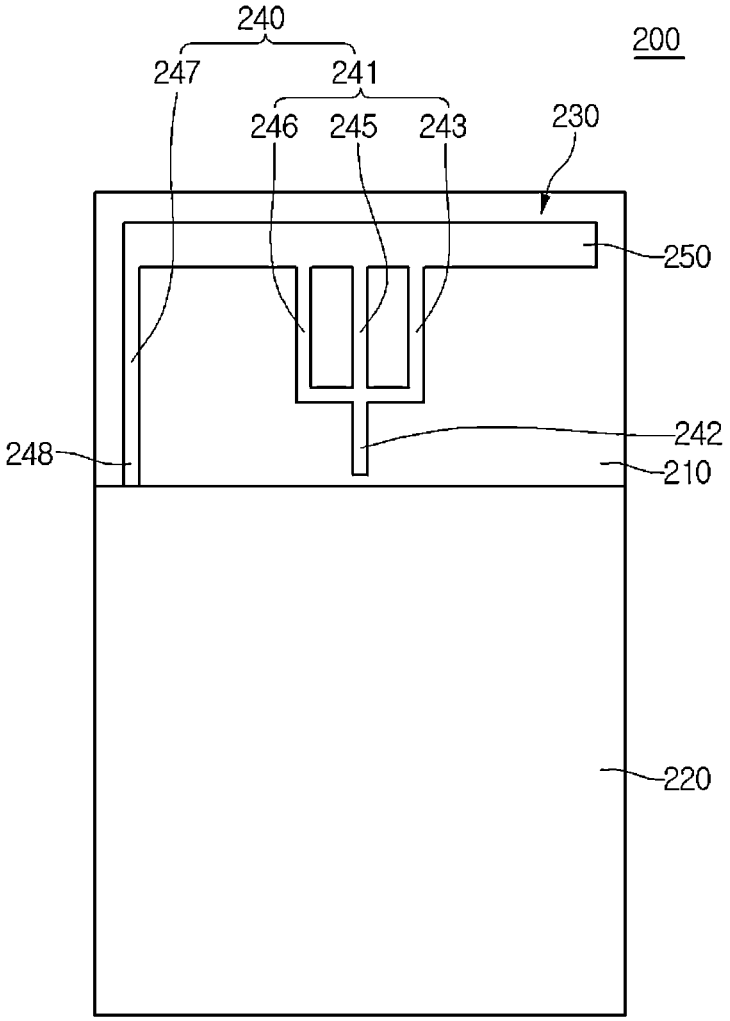
FIG. 9 is a plane view showing the second modifying example of an antenna apparatus according to the second embodiment.

FIG. 9 is a plane view showing the second modifying example of an antenna apparatus according to the second embodiment.

Referring to FIG. 9, the antenna apparatus 200 according to the embodiment includes a plurality of feeding units 241. In this case, as described above, the antenna apparatus 100 may include two feeding units 241, or at least three feeding units 241. For example, the feeding units 241 may include a first feeding unit 243, a second feeding unit 245 and a third feeding unit 246. In this case, the second feeding unit 245 may be disposed between the first and third feeding units 245 and 246, and the third feeding unit 246 may be disposed between the second feeding unit 245 and the ground unit 247.

In addition, the feeding units 241 are coupled to each other at one ends thereof. In other words, the feeding units 241 diverge from each other at the other ends thereof. In addition, the feeding units 241 may have mutually different lengths or the same length. Further, the feeding units 241 may have mutually different shapes. In this case, two of the feeding units 241 may be symmetrical to each other. All of the feeding units 241 may be asymmetrical to each other.

In this case, according to the antenna apparatus 200 of the embodiment, the number of feeding units 241, the divergence position and the lengths and shapes of the feeding units 241 are determined according to the predetermined ground condition. In other words, the number of feeding paths FP and size and shape of each feeding path FP may be determined according to the ground condition predetermined in the antenna apparatus 200. In this case, the ground condition is to determine the performance of the ground member 220 and for example, includes the size of the ground member 120. For this reason, the reflection coefficient may be significantly reduced at the resonance frequency band of the antenna apparatus 200. In addition, the operation efficiency of the antenna apparatus 200 may be improved.

Figure 10:
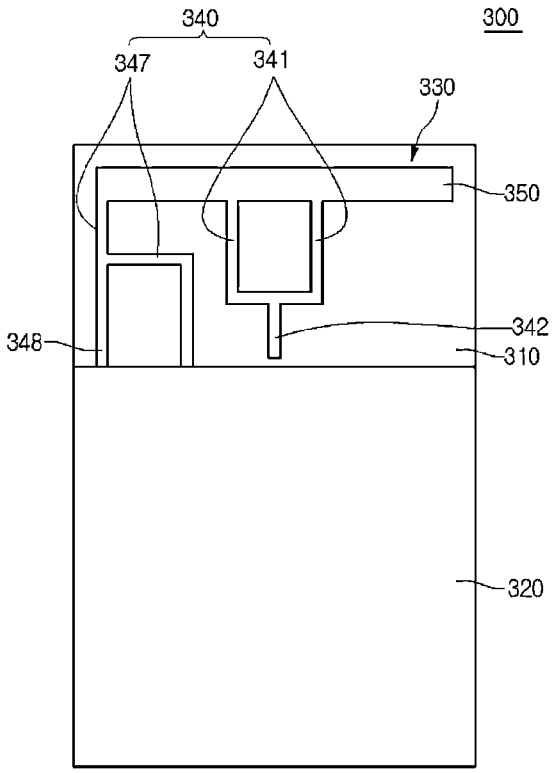
FIG. 10 is a plane view showing an antenna apparatus according to the third embodiment.
Figure 11:
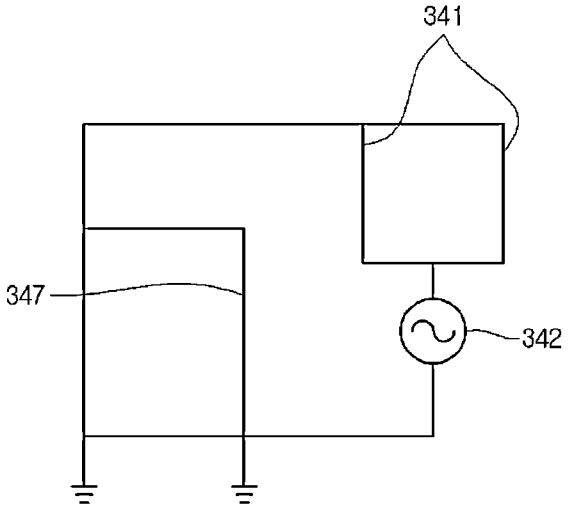
FIG. 11 is a circuit diagram showing an equivalent circuit of a feeding structure in FIG. 10.

FIG. 10 is a plane view showing an antenna apparatus according to the third embodiment. FIG. 11 is a circuit diagram showing an equivalent circuit of a feeding structure in FIG. 10.

Referring to FIG. 10, the antenna apparatus 300 according to the embodiment include a drive substrate 310, a ground member 320 and an antenna element 330. In addition, the antenna element 330 includes a feeding structure 340 and a radiator 350. Since the configurations of the embodiment are similar to those of the above-described embodiment, the detail descriptions will be omitted.

Only, the feeding structure 340 of the embodiment includes a plurality of feeding units 341 and a plurality of ground units 347.

The feeding units 341 provide a signal to the feeding structure 340. The feeding units 341 make contact with a transmission line through one ends thereof. In this case, the one ends of the feeding units 341 are defined as a feeding point (FP) 342. For example, the feeding point 342 may make contact with the transmission line at a location close to the ground member 320. In other words, the feeding point 342 does not make contact with the ground member 220. Thus, a signal is provided from a control module to the feeding units 341. Further, each of the feeding units 341 extends from the feeding point 342 through the other end thereof. Thus, a signal is supplied from one ends of the feeding units 341 to the other ends of the feeding units 341.

In this case, the feeding units 341 are coupled to each other at the one ends thereof. In other words, the feeding units 341 diverge from each other at the other ends thereof. The feeding units 341 have the same length. In addition, the feeding units 341 have mutually different shapes. The feeding units 341 may be symmetrical to each other.

The feeding structure 340 is grounded through the ground units 347. That is, the ground units 347 connect the feeding units 341 to the ground member 320. Each of the ground units 347 makes contact with the ground member 320 through one end thereof. The one end of each of the ground units 347 is defined as the ground point 348. That is, the ground units 347 make contact with the ground member 320 at a plurality of ground points 348. In addition, each of the ground units 347 extends from the ground member 320 through the other end thereof. In this case, each of the ground units 247 makes contact with the feeding units 341 through the other end thereof. Thus, the ground units 347 are grounded to the ground member 320 and transfer a signal from the feeding units 341 to the ground member 320.

In this case, the ground units 347 are coupled to each other at one ends thereof. In other words, the ground units 347 diverge from each other at the other ends thereof. In addition, the ground units 347 have mutually different lengths. The ground units 347 have mutually different shapes. In this case, the ground units 347 may be asymmetrical to each other.

In addition, the feeding structure 340 is designed to have a predetermined electrical property. For example, as shown in FIG. 11, the feeding structure 340 may be designed. The feeding units 341 and the ground units 347 are expressed as conductive wires.

That is, the feeding units 342 extend individually from the feeding point 342 and the ground units 347 extend from the feeding units 341, so that the feeding units 341 are grounded. In this case, a plurality of signal transferring paths TP is formed in the feeding structure 340. In this case, the signal transferring paths include a plurality of feeding paths FP and a plurality of ground paths SP. That is, a signal is transferred along each feeding path FP from the feeding units 341. In addition, a signal is transferred from the feeding units 341 along each ground path SP.

In this case, according to the antenna apparatus 300 of the embodiment, the number of feeding units 341, and the divergence position and the lengths and shapes of the feeding units 341 are determined according to the predetermined ground condition In other words, the number of feeding paths FP, the size and shape of each feeding path FP, the number of ground paths SP, and the size and shape of each ground path SP may be determined according to the ground condition predetermined in the antenna apparatus 300. In this case, the ground condition is to determine the performance of the ground member 320 and for example, includes the size of the ground member 320. For this reason, the reflection coefficient may be significantly reduced at the resonance frequency band of the antenna apparatus 300. In addition, the operation efficiency of the antenna apparatus 300 may be improved.

Meanwhile, in the above-described embodiments, the antenna element 130, 230 or 330 provided in the drive substrate 110, 210 or 310 has been disclosed as an example, but the embodiments are not limited the above. That is, even though at least a part of the antenna element is not provided in the drive substrate 110, 210 or 310, it is possible to implement the embodiments. For example, when the antenna apparatus 100, 200 or 300 is mounted on a communication terminal (not shown), at least a part of the antenna element 130, 230 or 330 may be mounted on an inner surface of an external case in the communication terminal. In this case, the drive substrate 110, 210 or 310 may be disposed in an inner space defined by the external case in the communication terminal. The antenna element 130, 230 or 330 may be directly attached onto the inner surface of the external case. In addition, after the antenna element 130, 230 or 330 may be attached to a mounting member (not shown) such as a carrier, the antenna element 130, 230 or 330 may be mounted on the inner surface of the external case. For example, the radiator 150, 250 or 350 of the antenna element 130, 230 or 330 may be attached to the external case.

Figure 12:
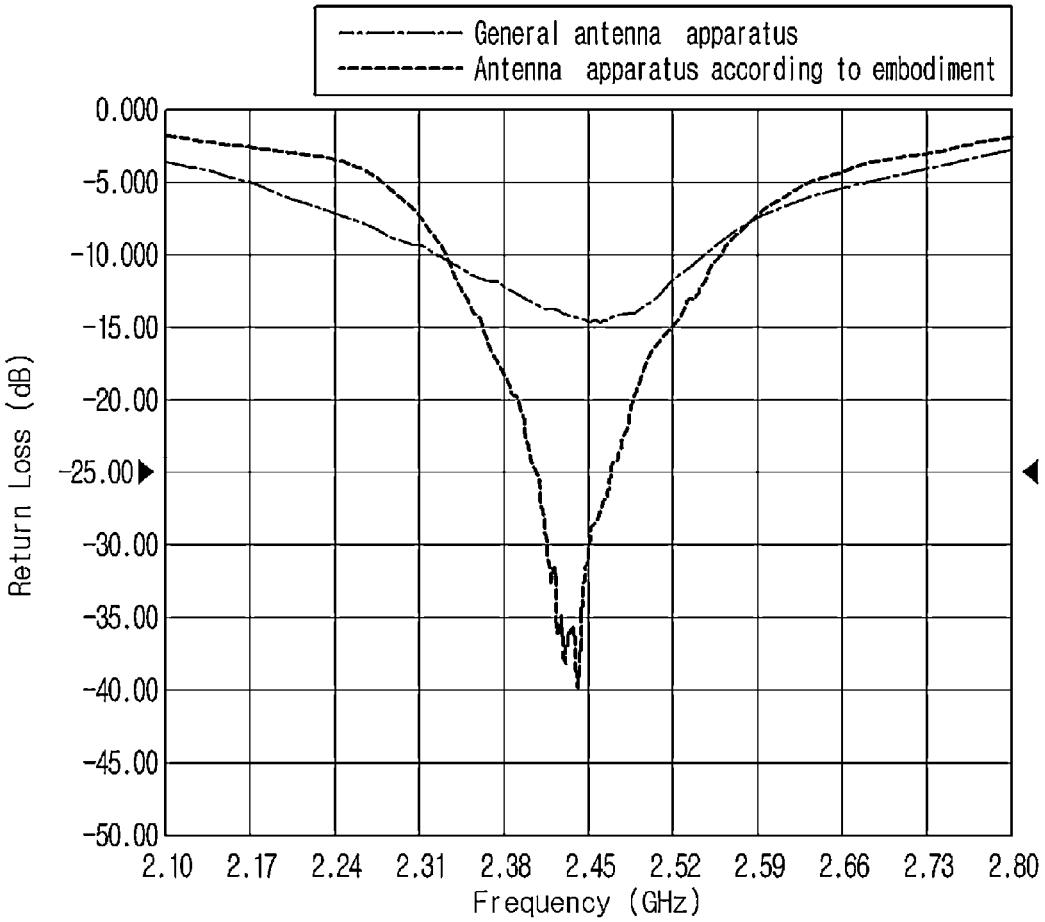
FIG. 12 is a graph illustrating a resonance frequency band of an antenna apparatus according to an embodiment; and FIG. 13*a* and FIG. 13*b* is a graph illustrating the operation efficiency of an antenna apparatus according to an embodiment.

FIG. 12 is a graph illustrating a resonance frequency band of an antenna apparatus according to an embodiment. FIG. 12 shows the variation of a reflection coefficient (Return Loss) according to a frequency. The reflection coefficient, which describes a voltage ratio (Output Voltage/Input Voltage) between an input and an output at a specific frequency, is expressed in a decibel scale.

Referring to FIG. 12, the resonance frequency band of the antenna apparatus 100 or 200 may be in the range of about 2.30 GHz to about 2.60 GHz. In this case, the resonance frequency band of the antenna apparatus 100, 200 or 300 according to the embodiment is similar to that of the antenna apparatus according to the related art. In this case, the antenna apparatus according to the related art includes a single feeding unit and a single ground unit. However, the reflection coefficient of the antenna apparatus 100, 200 or 300 according to the embodiment is significantly reduced at the resonance frequency band as compared with that of the antenna apparatus according to the related art.

Figure 13A:
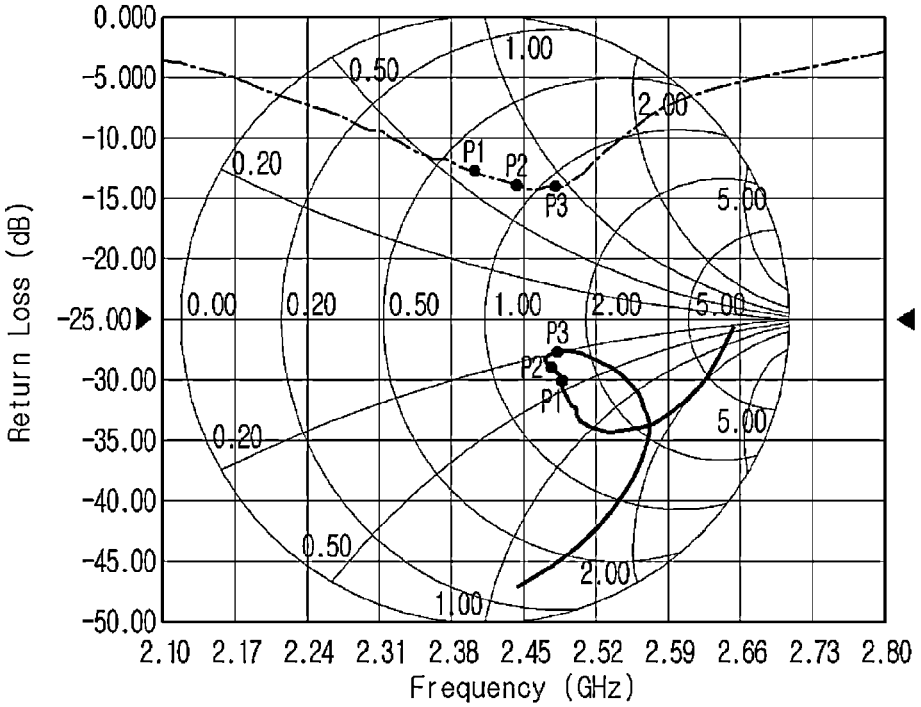
Figure 13B:
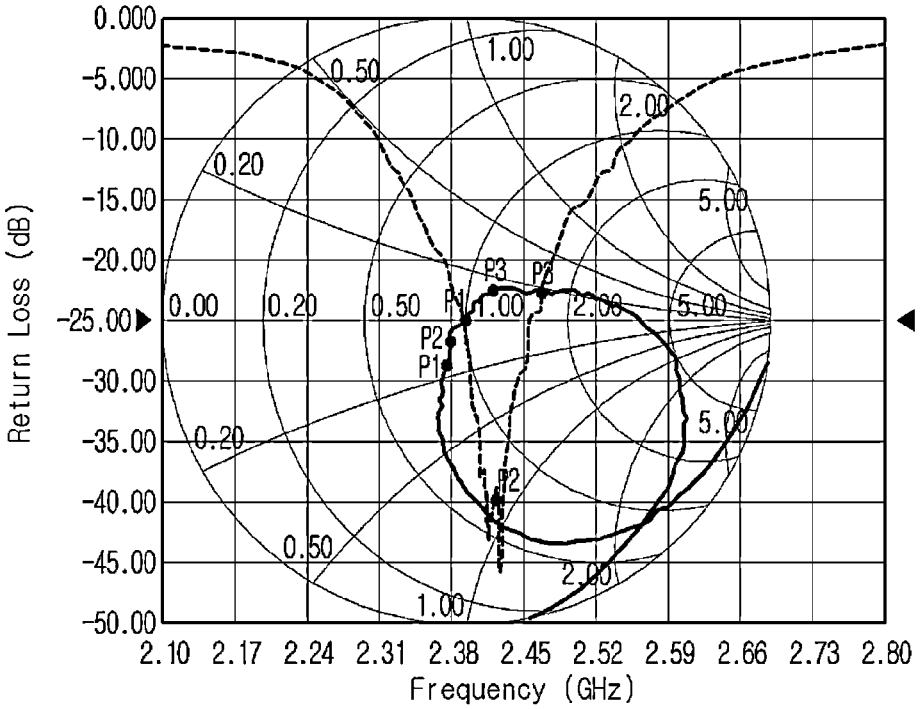

FIG. 13 is a graph illustrating the operation efficiency of an antenna apparatus according to an embodiment. The Smith chart shows the relation between impedance and reflection coefficient and represents that the operation efficiency becomes high as the reflection coefficient approaches the central point (1.00). According to (a) and (b) of FIG. 13, P1 is a point corresponding to 2.40 GHz, P2 is a point corresponding to 2.44 GHz and P3 is a point corresponds to 2.48 GHz.

Referring to FIG. 13, the reflection coefficients corresponding to P1, P2 and P3 of the antenna apparatus according to the related art are equal to −12.776 dB, −13.914 dB and −14.187 dB, respectively. The reflection coefficients corresponding to P1, P2 and P3 of the antenna apparatus according to the related art are denoted in the Smith chart of (a) of FIG. 13. Meanwhile, the reflection coefficients corresponding to P1, P2 and P3 of the antenna apparatus 100, 200 or 300 according to the embodiment are equal to −22.539 dB, −38.783 dB and −22.600 dB. The reflection coefficients corresponding to P1, P2 and P3 of the antenna apparatus 100 or 200 according to the embodiment are denoted in the Smith chart of (b) of FIG. 13.

In other words, when (a) and (b) of FIG. 13 are compared with each other, the Smith chart corresponding to P1, P2 and P3 of the antenna apparatus 100, 200 or 300 according to the embodiment is closed to the central point as compared with that of the antennal apparatus according to the related art. Therefore, the antenna apparatus 100, 200 or 300 according to the embodiment has higher operation efficiency.

The antenna apparatus 100, 200 or 300 according to the embodiment include a plurality of signal transferring paths. That is, a signal is transferred along the signal transferring paths in the antenna apparatus 100, 200 or 300. In detail, the antenna apparatus 100, 200 or 300 includes the plurality of ground units 143, 247 and 347 so that a plurality of ground paths may be formed. Meanwhile, the antenna apparatus 100, 200 or 300 according to the embodiment include a plurality of feeding units 141, 241 and 341 so that a plurality of feeding paths may be formed. Thus, according to the antenna apparatus 100, 200 or 300, signals are transferred through the feeding paths. For this reason, the reflection coefficient is significantly reduced at the resonance frequency band of the antenna apparatus 100, 200 or 300. In addition, the operation efficiency of the antenna apparatus 100, 200 or 300 is improved. Thus, the operation efficiency of the antenna apparatus 100 or 200 can be improved without enlarging the size of the antenna apparatus 100, 200 or 300.

Although exemplary embodiments have been described in detail hereinabove, it should be clearly understood that many variations and modifications of the basic inventive concepts herein taught which may appear to those skilled in the present art will still fall within the spirit and scope of the embodiments, as defined in the appended claims.

What is claimed is:

1. A feeding structure (340) comprising:

a first feeding unit (341);

a second feeding unit (341);

a feeding point (342);

a first ground unit (348);

a second ground unit (348); and a ground member (320) including a first ground point and a second ground point;

wherein one end of the feeding point (342) is connected to one end of the first feeding unit (341) and one end of the second feeding unit (341), wherein the other end of the feeding point (342) is connected to the first ground point and the second ground point of the ground member (320), wherein the feeding structure includes a connecting line, wherein one end of the connecting line is connected to the other end of the first feeding unit (341) and the other end of the second feeding unit (341), wherein the other end of the connecting line is connected to one end of the first feeding unit (341) and one end of the second feeding unit (341), wherein the other end of the first ground unit (348) is connected to the first ground point, wherein the other end of the second ground unit (348) is connected to the second ground point, wherein the feeding point (342) generates a signal, wherein the signal is supplied to the ground member (320) through a first path and a second path;

wherein the first path includes the first feeding unit (341), the connecting line, and the first feeding point (347);

wherein the second path includes the second feeding unit (341), the connecting line, and the second feeding point (347);

wherein the ground member (320) radiates the signal at a resonance frequency, and wherein a band of the resonance frequency is 2.30 GHz to 2.60 GHz.

2. The feeding structure of claim 1, comprising a plurality of ground units.

3. The feeding structure of claim 2, wherein the ground units have mutually different lengths.

4. The feeding structure of claim 2, wherein the ground units have mutually different shapes.

5. The feeding structure of claim 2, wherein the ground units diverge from each other.

6. The feeding structure of claim 1, comprising a plurality of feeding units.

7. The feeding structure of claim 6, wherein the feeding units extend from the feeding point and diverge from each other.

8. The feeding structure of claim 6, wherein the feeding units have mutually different lengths.

9. The feeding structure of claim 6, wherein the feeding units have mutually different shapes.

10. The feeding structure of claim 1, wherein the ground member radiates a signal supplied from the feeding unit.

11. An antenna apparatus (300) comprising:

a feeding structure (340); and a radiator (330) to radiate a signal supplied from the feeding structure (340), wherein the feeding structure (340) comprises:

a first feeding unit (341);

a second feeding unit (341);

a feeding point (342);

a first ground unit (348);

a second ground unit (348);

a connecting line; and a ground member (320) including a first ground point and a second ground point;

wherein one end of the feeding point (342) is connected to one end of the first feeding unit (341) and one end of the second feeding unit (341), wherein the other end of the feeding point (342) is connected to the first ground point and the second ground point of the ground member (320), wherein one end of the connecting line is connected to the other end of the first feeding unit (341) and the other end of the second feeding unit (341), wherein the other end of the connecting line is connected to one end of the first feeding unit (341) and one end of the second feeding unit (341), wherein the other end of the first ground unit (348) is connected to a first portion of the first ground point, wherein the other end of the second ground unit (348) is connected to the ground point, wherein the feeding point (342) generates a signal, wherein the signal is supplied to the ground member (320) through a first path and a second path;

wherein the first path includes the first feeding unit (341), the connecting line, and the first feeding point (347);

wherein the second path includes the second feeding unit (341), the connecting line, and the second feeding point (347);

wherein the signal is supplied to the radiator (330), wherein the antenna apparatus (3001 radiates the signal through the ground member (320) and the radiator (330) at a resonance frequency, and wherein a band of the resonance frequency is 2.30 GHz to 2.60 GHz.

12. The antenna apparatus of claim 11, wherein the feeding structure comprises a plurality of ground units.

13. The antenna apparatus of claim 12, wherein the ground units have mutually different lengths.

14. The antenna apparatus of claim 12, wherein the ground units have mutually different shapes.

15. The antenna apparatus of claim 12, wherein the ground units diverge from each other.

16. The antenna apparatus of claim 11, wherein the feeding unit comprises a plurality of feeding units.

17. The antenna apparatus of claim 16, wherein the feeding units extend from the feeding point and diverge from each other.

18. The antenna apparatus of claim 16, wherein the feeding units have mutually different lengths.

19. The antenna apparatus of claim 16, wherein the feeding units have mutually different shapes.

20. The antenna apparatus of claim 11, wherein the ground member radiates the signal together with the radiator.

* * * * *